US012723483B2

(12) United States Patent
Randle et al.

(10) Patent No.: US 12,723,483 B2
(45) **Date of Patent: *Sep. 1, 2026**

(54) ON-DEMAND VIBRATION TOOL FOR DRILLING APPLICATIONS

(71) Applicant: Dynomax Drilling Tools Inc., Leduc (CA)

(72) Inventors: Hartley Randle, Parkland County (CA); Brandon Jullion, Beaumont (CA); Joshua Gamble, Spruce Grove (CA)

(73) Assignee: Dynomax Drilling Tools Inc., Leduc (CA)

( * ) Notice: Subject to any disclaimer, the term of this patent is extended or adjusted under 35 U.S.C. 154(b) by 0 days.

This patent is subject to a terminal disclaimer.

(21) Appl. No.: 19/192,148

(22) Filed: Apr. 28, 2025

(65) Prior Publication Data

US 2025/0257625 A1 Aug. 14, 2025

Related U.S. Application Data

(63) Continuation-in-part of application No. 18/178,388, filed on Mar. 3, 2023, now Pat. No. 12,546,186.

(30) Foreign Application Priority Data

Oct. 28, 2022 (CA) ..... 3180354
Apr. 27, 2025 (CA) ..... 3271982

(51) Int. Cl.
*E21B 31/00* (2006.01)
*E21B 4/02* (2006.01)
*E21B 44/00* (2006.01)

(52) U.S. Cl.
CPC ..... *E21B 31/005* (2013.01); *E21B 4/02* (2013.01); *E21B 44/00* (2013.01)

(58) Field of Classification Search
CPC ..... E21B 31/005; E21B 4/02
See application file for complete search history.

(56) References Cited

U.S. PATENT DOCUMENTS 4,058,163 A 11/1977 Yandell
4,768,598 A 9/1988 Reinhardt
(Continued)

FOREIGN PATENT DOCUMENTS

CA 2872736 C 12/2015

OTHER PUBLICATIONS

Office Action Summary (Examination Result) and Search Report dated Mar. 10, 2026, in connection with UAE Patent Application P6003311/2023, 10 pages.

*Primary Examiner* — Giovanna Wright

(57) ABSTRACT

There is a downhole tool for use in a drill string including a friction-reducing vibration tool and a bypass control. The vibration tool includes a rotary driving device responsive to fluid flow in the drill string, a valve including a rotary component and a stationary component configured to rotate relative to each other to vary flow through the valve, the rotary component of the valve driven by the rotary driving device, and a bypass passage around or through one or more of the rotary driving device and the valve. The bypass control has a sensor for detecting a stimulus, a bypass actuator for controlling an amount of fluid flow through the bypass passage to activate or deactivate the vibration tool, and a processor in communication with the sensor to control the bypass actuator in response to signals from the sensor. There is a method of activating or deactivating the friction-reducing vibration tool in a drill string by detecting a stimulus using the sensor and electrically activating or deactivating the tool in response to signals from the sensor.

18 Claims, 16 Drawing Sheets

(56) References Cited

U.S. PATENT DOCUMENTS

| | | | |
|---|---|---|---|
| 4,819,745 | A | 4/1989 | Walter |
| 4,890,682 | A | 1/1990 | Worrall et al. |
| 4,979,577 | A | 12/1990 | Walter |
| 6,279,670 | B1 | 8/2001 | Eddison et al. |
| 6,431,294 | B1 | 8/2002 | Eddison et al. |
| 6,439,318 | B1 | 8/2002 | Eddison et al. |
| 7,139,219 | B2 | 11/2006 | Kolle et al. |
| 7,523,792 | B2 | 4/2009 | El-Rayes et al. |
| 7,757,781 | B2 | 7/2010 | Hay et al. |
| 8,162,078 | B2 | 4/2012 | Anderson |
| 8,167,051 | B2 | 5/2012 | Eddison et al. |
| 9,004,194 | B2 | 4/2015 | Eddison et al. |
| 9,091,123 | B2 | 7/2015 | Gust |
| 9,598,923 | B2 | 3/2017 | Gilleylen et al. |
| 9,637,976 | B2 | 5/2017 | Lorenson et al. |
| 9,765,584 | B2 | 9/2017 | Lorenson et al. |
| 9,932,774 | B2 | 4/2018 | Gillis |
| 10,465,464 | B2 | 11/2019 | Campbell |
| 10,619,437 | B2 | 4/2020 | Lorenson et al. |
| 10,648,265 | B2 | 5/2020 | Kinsella et al. |
| 10,677,006 | B2 | 6/2020 | von Gynz-Rekowski et al. |
| 10,829,993 | B1 | 11/2020 | von Gynz-Rekowski et al. |
| 10,927,601 | B2 | 2/2021 | Lorenson et al. |
| 10,968,721 | B2 | 4/2021 | Lorenson et al. |
| 10,989,004 | B2 | 4/2021 | Russell et al. |
| 11,002,099 | B2 | 5/2021 | Clausen et al. |
| 2005/0115714 | A1 | 6/2005 | Millet et al. |
| 2005/0257931 | A1* | 11/2005 | Mody ..... E21B 31/005 166/301 |
| 2008/0164062 | A1 | 7/2008 | Brackin et al. |
| 2011/0036631 | A1 | 2/2011 | Prill et al. |
| 2014/0246234 | A1* | 9/2014 | Gillis |
| 2015/0260014 | A1 | 9/2015 | Zimmerman |
| 2015/0337652 | A1* | 11/2015 | Rodney ..... E21B 4/02 367/82 |
| 2018/0149002 | A1 | 5/2018 | Murdoch et al. |
| 2020/0011146 | A1* | 1/2020 | Samuel ..... E21B 4/04 |
| 2021/0262340 | A1* | 8/2021 | Moody ..... E21B 47/09 |
| 2022/0003063 | A1* | 1/2022 | Switzer ..... E21B 47/00 |
| 2022/0034165 | A1* | 2/2022 | Espinoza ..... E21B 34/10 |
| 2023/0296013 | A1* | 9/2023 | Lanning ..... E21B 44/04 |
| 2024/0141750 | A1* | 5/2024 | Randle ..... E21B 34/066 |

* cited by examiner

ON-DEMAND VIBRATION TOOL FOR DRILLING APPLICATIONS

CROSS-REFERENCE TO RELATED APPLICATIONS

This application is a continuation-in-part of application Ser. No. 18/178,388, filed Mar. 3, 2023, which claims priority to Canadian Application No. 3,180,354, filed Oct. 28, 2022; and this application also claims priority to Canadian Application No. 3,271,982, filed Apr. 27, 2025, the disclosures of which are incorporated herein by reference.

TECHNICAL FIELD

This relates to electrically activating and deactivating vibration tools used in the drilling of oil and gas wells.

BACKGROUND

Many downhole tools operate based on fluid pressure. By diverting or altering a flow path through a tool, various systems and functions can be activated or deactivated. Sometimes this can be accomplished through fully mechanical means, such as dropping a ball from surface into a ball seat or having a spring that allows a sleeve to travel and block/unblock a flow path based on the pressure or amount of flow.

The downside of such activation devices is that they either only allow for a single "on" activation, or they limit the available flow parameters in either the "on" or "off" position. It is advantageous to have an activation system that can both activate and deactivate a system that is not directly tied to fluid flowrate, or a mechanical spring.

When drilling oil and gas wells, a directional approach to drilling is often employed, where the first section of the well is vertical, and the subsequent section is lateral (or horizontal). Drilling the horizontal section has various challenges. A significant challenge is to effectively transfer the weight of the drill string in the vertical section to the drill bit in the horizontal section. Friction created as the drill string advances through the horizontal section can cause difficulties. One method to aid in the weight transfer is through the use of an axial vibration tool, where one or multiple tools are placed in various locations throughout the string, and help to break the wellbore friction by imparting vibration to the drill string.

It is often beneficial to not have the vibration tool activate until it has reached the lateral section of the wellbore. This can be beneficial for several reasons, including preventing damage to casing, and extending the life of the components by only operating as needed.

Several current methods exist for activating such an assembly, many of which are based on dropping a projectile from the surface in order to modify the flow path through the tool and activate the valve. Often these methods are a simple "on" switch, with no ability to turn the tool off, and the drilling string must be tripped out of hole in order to remove the projectile and reset the tool. This can be a major inconvenience when drilling a well with multiple "legs" or lateral sections.

SUMMARY

There is disclosed in one embodiment a downhole tool for use in a drill string. The downhole tool includes a friction-reducing vibration tool which includes a rotary driving device responsive to fluid flow in the drill string, a valve including a rotary component and a stationary component configured to rotate relative to each other to vary flow through the valve, the rotary component of the valve driven by the rotary driving device, and a bypass passage around or through one or more of the rotary driving device and the valve. The downhole tool includes a bypass control, comprising a sensor for detecting a stimulus, a bypass actuator for controlling an amount of fluid flow through the bypass passage to activate or deactivate the friction-reducing vibration tool, and a processor in communication with the sensor to control the bypass actuator in response to signals from the sensor indicative of the stimulus being detected.

In various embodiments, there may be included any one or more of the following features: the stimulus is a condition downhole; the stimulus is a control signal received from surface; the control signal is a series of timed pump cycles; the control signal is a series of timed rotary cycles; the control signal is a variation in pressure cycles; the rotary driving device is a Moineau-style rotor within a stator; the bypass actuator is an electric motor and a ball screw; the bypass actuator is a valve poppet that is axially moveable to vary the amount of fluid flow through the bypass passage; and the sensor is one or more of: an accelerometer, a magnetometer, a pressure sensor or a thermocouple.

There is disclosed in one embodiment a method of activating or deactivating a friction-reducing vibration tool in a drill string. A stimulus is detected using a sensor. The friction-reducing vibration tool is electrically activated or deactivated in response to signals from the sensor indicative of the stimulus being detected.

In various embodiments, there may be included any one or more of the following features: generating a control signal from surface, and transmitting the control signal downhole, wherein the control signal is the stimulus; activating or deactivating a plurality of friction-reducing vibration tools in a drill string at the same time using the control signal; wherein the friction-reducing vibration tool comprises: a rotary driving device responsive to fluid flow in the drill string, a valve including a rotary component and a stationary component configured to rotate relative to each other to vary flow through the valve, the rotary component of the valve driven by the rotary driving device, and a bypass passage around or through one or more of the rotary driving device and the valve, and wherein electrically activating or deactivating the friction-reducing vibration tool comprises activating or deactivating a bypass control to vary the flow through the bypass passage; the stimulus is a condition downhole; the control signal is a series of timed pump cycles; the control signal is a series of timed rotary cycles; the control signal is a variation in pressure cycles; and the bypass control includes the sensor, a bypass actuator for controlling an amount of fluid flow through the bypass passage to activate or deactivate the friction-reducing vibration tool, and a processor in communication with the sensor to control the bypass actuator in response to signals from the sensor indicative of the stimulus being detected.

These and other aspects of the device and method are set out in the claims.

BRIEF DESCRIPTION OF THE DRAWINGS

Embodiments Will Now be Described with Reference to the Figures, in which Like Reference Characters Denote Like Elements, by Way of Example, and in which.

DETAILED DESCRIPTION

Immaterial modifications may be made to the embodiments described here without departing from what is covered by the claims.

There is disclosed in one embodiment a method of activating a linear valve in order to divert or alter the fluid path through a tool in response to a measured or transmitted stimuli.

There is disclosed in one embodiment a method of activating a rotary valve in a downhole tool through an electronically powered apparatus in response to a downhole measurement or pre-set activation criterion.

Figure 1:
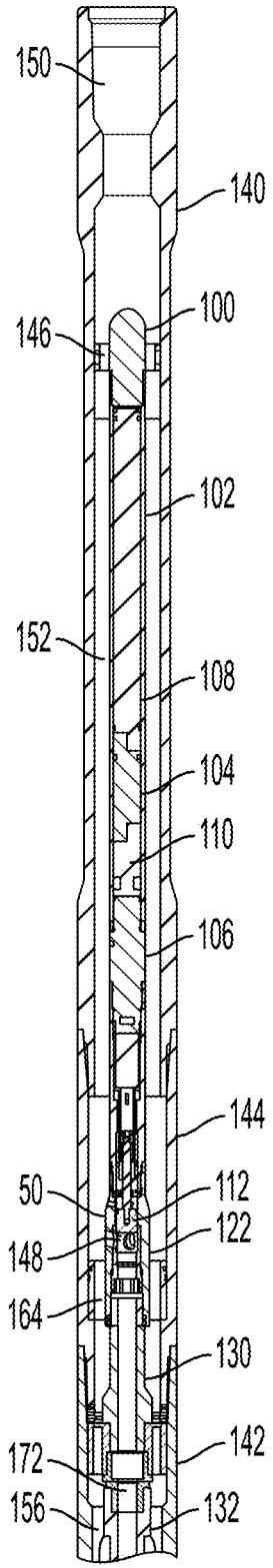
FIG. 1 is a cross-section of an activation device having a valve according to one embodiment.

As shown in FIG. 1, there is an activation device 50 within an assembly with a series of housings 140, 144, and 142 that separates an internal fluid path 150, often referred to as the standpipe from the external fluid path, or annulus, of the drilling string. The internal fluid path 150 is uninterrupted through the housing and progresses through the centralizer 100 that holds the electronics package in the center of the housing 140. A pressure sleeve 102 holds a battery 108, sensor package 104, snubber 110 and is connected to the motor bulkhead 106. The area within the centralizer and around the pressure sleeve 146 and 152 forms part of the continuous fluid path.

The sensor package could also have a receiver, for receiving wireless transmissions for activation/deactivation, alternatively or additionally it could contain one or more of an accelerometer, magnetometer, pressure sensor, or thermocouple. The sensor can detect a condition downhole, and a processor may operate the valve poppet in response to the condition detected. In a preferred embodiment, the sensor may include an accelerometer and a magnetometer to determine an inclination setting using the processor. In other embodiments, mechanical and/or pressure switches could be used without a processor, which would have a simpler design but would be less precise and more complicated to turn off. The battery may be connected to the sensor and the processor. Other power sources can be used. For example, a turbine 400 (FIG. 14) could be used as a power source, which would be able to harness power from the fluid flow within the system. Below the motor bulkhead 106 are further components that will be detailed in later figures.

The sensor package allows for the operation of an electronically activated valve based on conditions downhole. Various types of valves can be used with the sensor package. In one embodiment of a downhole valve for use in a standpipe shown in FIGS. 2 and 3, there may be a valve body 122 defining a flow path and a valve positioner, for example, valve poppet 112, that is moveable relative to the valve body to vary flow through the flow path. The downhole valve may be any one of various types of valves, including a rotary valve, a poppet valve or other valve that can be activated based on readings of the sensors. An electrically activated linear activation system is connected to the valve positioner to move the valve positioner relative to the valve body. The sensor detects a condition downhole and the processor is configured to move the valve positioner relative to the valve body to vary flow through the flow path in response to the condition detected. The operation of the valve may activate a vibration tool or other downhole tool by diverting flow to or from the downhole tool. For example, the valve may direct flow either through a bypass passage or through the valve of a vibration tool to turn the vibration tool on or off. Optionally, the valve may incrementally vary the amount of flow between the bypass passage and the valve of the vibration tool to vary the magnitude of vibrations created by the vibration tool. In another embodiment, the operation of the valve may activate an activated reamer. In general, embodiments of the electrically activated downhole valve described herein may be used to activate any type of downhole tool which can be fluid activated and for which it is desirable for the tool to be predictably activated or deactivated.

Figure 2:
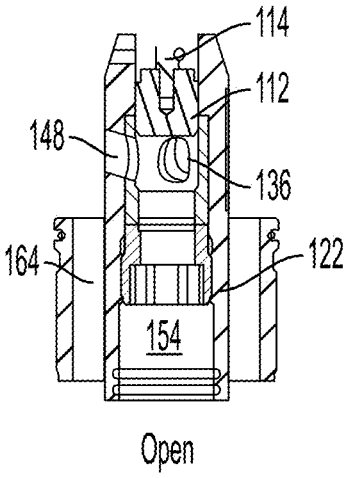
FIG. 2 is a cross-section of the valve of FIG. 1 having a valve poppet in an open position.
Figure 3:
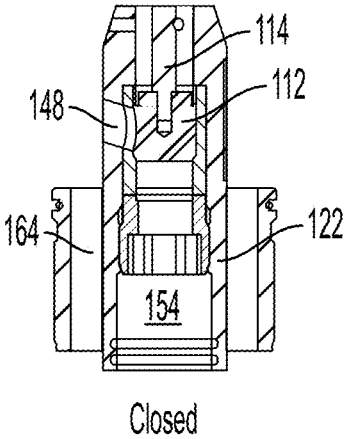
FIG. 3 is a cross-section of the valve poppet of FIG. 2 in a closed position.

As shown in FIGS. 2 and 3, the valve body 122 has one or multiple openings 136 that split the fluid path into an internal flow path 154 or an external flow path 164 and 156. The valve poppet 112 is located within the valve body 122, and can close off the internal fluid path that is composed of a wash tube 130 and potentially various other components below 132. An interface 172 seals the bore for the activation unit. In embodiments where the activation device is attached to a vibration tool having a rotor and a stator, the interface 172 forms part of the rotary to stationary interface and keeps the electronics stationary and the rotor rotational. Since the rotor has an eccentric rotation, two carbide plates may be used for the interface and seal.

The valve body 122 and valve poppet 112 collectively define a downhole valve that is installed in the standpipe. The valve body 122 has a flow path through the valve body.

The valve poppet 112 sits within the valve body 122 and is axially movable in a direction parallel with the standpipe when in use. It will be understood that the valve poppet 112 being moveable in a direction parallel to the standpipe does not mean that the poppet moves exactly parallel to the axis of the standpipe, but that the substantial direction of movement of the poppet is along the axis of the drill string at the location of the valve in the drill string.

The electronics package includes an electrically activated linear activation system connected to the valve poppet 112 to move the valve poppet axially. The linear activation system may include an electric motor and a ball screw. Other mechanisms may be used to electrically activate the valve poppet.

FIGS. 2 and 3 show the valve poppet 112 in its two nominal positions, open or closed, respectively. The flow through the flow path varies as the valve poppet is moved axially.

In the open position in FIG. 2, the poppet rod 114 is retracted, thereby exposing the valve body's internal fluid path 148, and allowing flow through one or more openings 136 to the washpipe through the path 154. The one or more openings in the valve body are at least partially covered by the valve poppet when the valve poppet is moved axially into the closed position. Various different configurations of openings and flow paths can be used. The size and location of the flow paths can control the size of the vibrations that can be generated in a vibration tool. When the valve is in the open position, flow may pass through both the internal fluid path and the external flow path 164.

In the closed position in FIG. 3, the poppet rod 114 is extended, thereby positioning the valve poppet 112 directly in the valve body's internal fluid path 148, and preventing through flow. This causes the entirety of the flow to progress through the outside fluid path 164.

The open position may be partially or fully open and allow fluid flow through the valve body's internal flow path 148. The closed position may be partially or fully closed and allow reduced or no flow through the valve body's internal flow path 148. As shown in FIGS. 2 and 3, the flow path through the valve body comprises at least two flow paths, one through the valve body's internal flow path 148 and the other into the washpipe flow path 154 and the axial movement of the valve poppet varies the amount of flow through each of the at least two flow paths. In some embodiments, the flow path modified by the downhole valve includes a first flow path in fluid connection with a passage between a rotor and a stator, and a second flow path in fluid connection with a bore in the rotor. In some embodiments, all of the at least two flow paths are contained within the standpipe, meaning that the valve operates to create vibration using positive pressure within the system rather than negative pressure.

Figure 4:
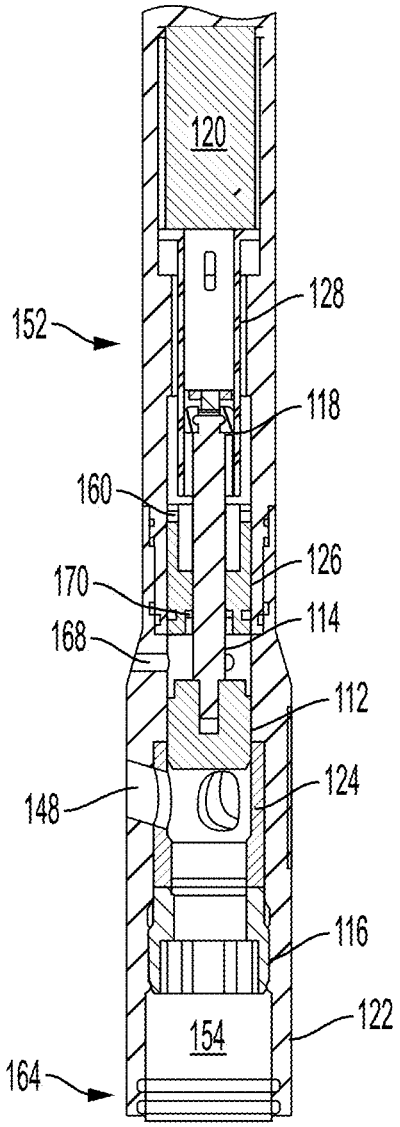
FIG. 4 is a cross-section of the activation system of the activation device of FIG. 1.

FIG. 4 shows further details of the activation system. The motor bulkhead contains a motor 120 and a ball screw 128 that is coupled through coupling 118 to the poppet rod 114. The bulkhead additionally has a floating piston 126 that is pressure compensated to the standpipe through a port hole 168, and sealed against the bulkhead using o-rings 160 and against the poppet rod 114 using an o-ring or u-cup style seal 170. The bulkhead is filled with oil for the operation of the motor and ball screw. Additionally, a gear box could be located between the motor 120 and ball screw 128 by extending the motor bulkhead. A gearbox has the additional benefit of increasing the closing force that can be applied by the ball screw 128 through the poppet rod 114 onto the valve poppet 112.

The valve body 122 contains a valve seat 124 that can be made of a hard material such as tungsten carbide to receive the valve poppet 112 once the system is activated. Other hard materials can be used. The valve poppet may also be made from a hard material such as tungsten carbide or other hard material. Additionally a seat lock 116 is positioned below the valve seat 124 to ensure it does not come loose or rotate during operation. The downhole valve may be installed to activate a vibration tool during drilling. The hard material used in the system components could be other components with a hard-faced layer other than tungsten carbide such as welded tungsten carbide with matrix or other materials created through other processes such as surface hardening steel. In a preferred embodiment, the hard material is formed using sintered carbide components to prevent wash damage on the valve components.

Figure 5:
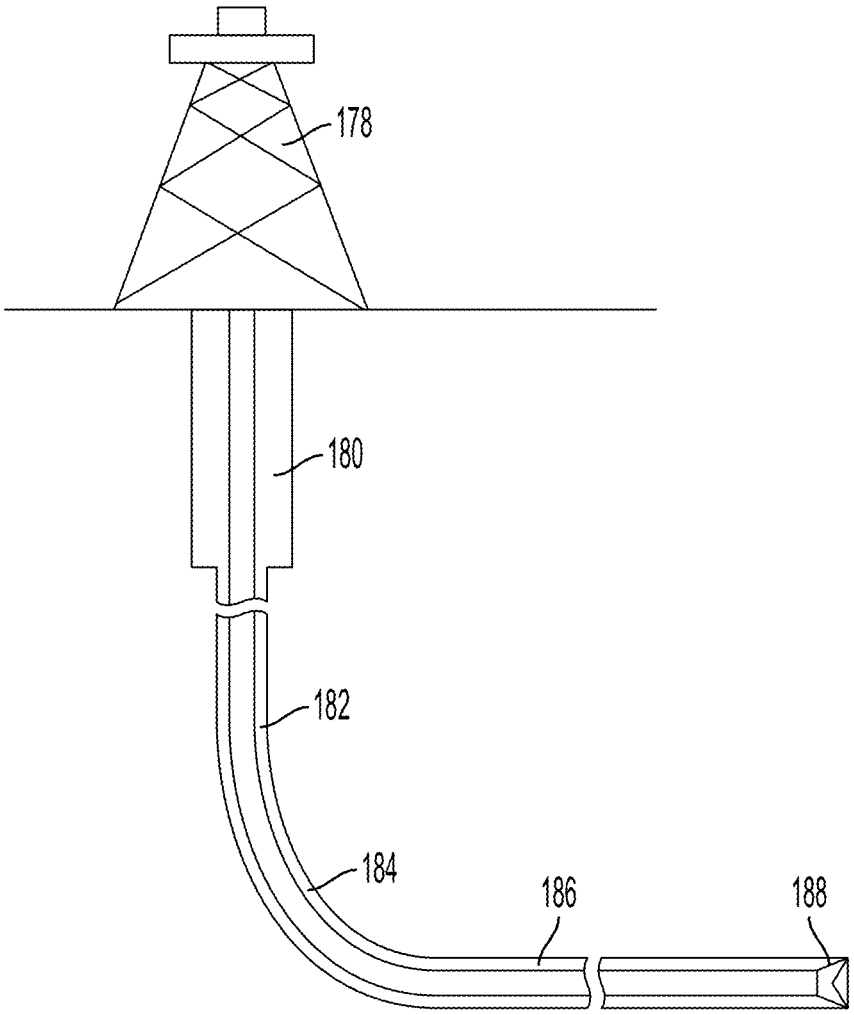
FIG. 5 is a schematic of a lateral well profile.

FIG. 5 shows an overview schematic of a lateral or deviated well plan for a drilling operation. A drilling rig 178 is installed at surface. In this embodiment, the vertical section of the well 180 is cased. In the following vertical section 182 and the curve 184, it is relatively easy to transfer the weight of the drill collar in the vertical section to the drill bit 188. However, as the lateral section of the well 186 extends, it can be very difficult to transfer weight to the drill bit 188. For this reason, vibration systems are employed which convert a pressure pulse into axial movement of the drill string. Although the horizontal portion of the well is shown as being level, a well bore may be described as horizontal despite not being precisely level. A horizontal portion of a wall may include a slight incline or slight decline relative to a precise measure of horizontal. However, it will be understood that a well bore that has a significant horizontal component may be described as being horizontal.

It is disadvantageous to have a vibration system that is always on, as the vibration can be damaging to the casing 180 when the system is activated inside of it. Instead, it is ideal to be able to activate the system "on-demand". When drilling a well with multiple lateral legs, the vibration system may be pulled back into the vertical cased section, so it is also advantageous to be able to turn the system "off" without having to trip and remove a mechanical activation device such as a ball or a dart.

The activation tools described herein provide for a method of activating a downhole valve for use in a standpipe. A condition downhole is detected using a sensor. The downhole valve is electrically activated based on the detected condition downhole. For example, the detected condition downhole is indicative that the standpipe is in a horizontal section of a well. The downhole valve may be used to activate a vibration tool during drilling. Various types of valves may be used to achieve this vibration, including any of the valve arrangements described herein.

Figure 6:
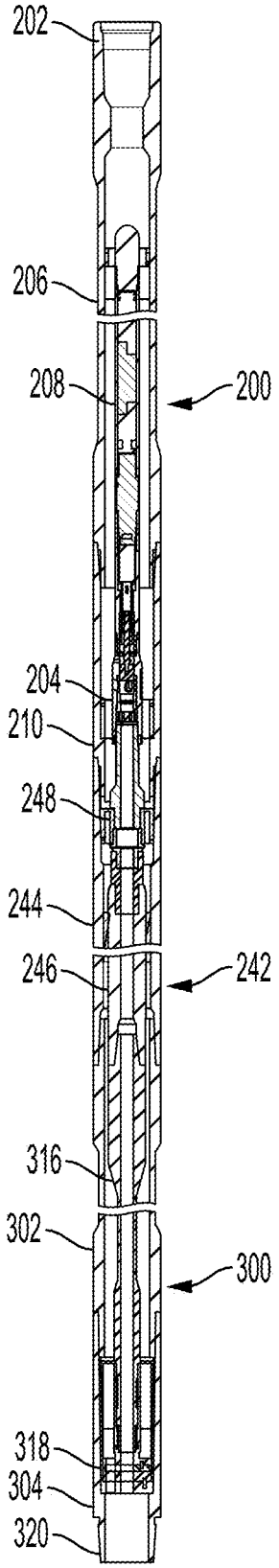
FIG. 6 is a cross-section of an activation device according to another embodiment.

As shown in in FIG. 6, the activation device includes an electronics assembly 200, a power section assembly 242 and a valve assembly 300, each assembly being composed of both housings 206, 210, 244, 302, 304 and internal components 208, 204, 246, 248, 316, 318. The housings have an uphole connection 202 which is designed to be threaded into the drill string, and a lower connection 320 designed to be threaded into either the drill string or a pressure responsive device such as a shock tool.

The electronics assembly 200 consists of two housings 206, 210 to facilitate assembly of the internal sonde 208 and bypass assembly 204 and to carry the loads transmitted through the drill string.

Below the electronics assembly 200 is the power section assembly 242 which consists of a stator 244 and a rotor 246, as well as the rotary to stationary diverter assembly 248. This assembly contains the interface between the electronics assembly internals 208 and 204 which are stationary relative to the housing, and the rotor 246 which moves both rotational and eccentrically within the stator 244.

Then at the bottom of the tool is the valve assembly 300, which contains external housings 302 and 304 for facilitating assembly and to carry the drill string loads, as well as an internal flexshaft 316 that connects the rotor 246 to the valve 318. Alternatively, the flex shaft could be replaced with a constant velocity joint.

Figure 7:
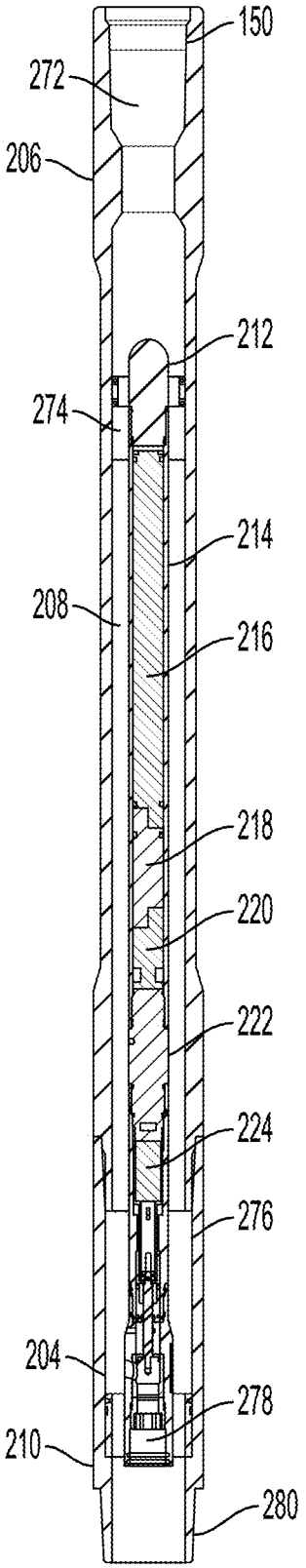
FIG. 7 is a cross-section of an electronics section of the activation device of FIG. 6.

The electronics assembly 200 is further detailed in FIG. 7.

The assembly is composed of two housings 206 and 210 for ease of assembly. The housings define an internal flow path 272. Inside the housings is a sonde 208 with a threaded mount on the downhole side, and a floating mount 212 on the uphole side. The floating mount 212 diverts the flow around the sonde. The sonde has a pressure housing 214 which contains a battery 216, a sensor and logic board or processor 218, and a snubber 220 for absorbing axial vibration. The pressure housing 214 connects to the motor bulkhead 222, which houses the motor and is attached to the ball screw 224 for increasing the closing power of the assembly. An electronics section 276 houses the electric motor, ball screw drive, and oil compensation piston. Outside of the electronics section is an internal flow path 274. A bore 278 has two o-rings to seal on a tube that goes to the rotary to stationary interface. The tube is allowed to move axially to accommodate changes of length of components. The axial movement of the tube allows for either tolerance stack up or component rework to fix damages. The base of the electronics assembly is a threaded connection 280.

Figure 8:
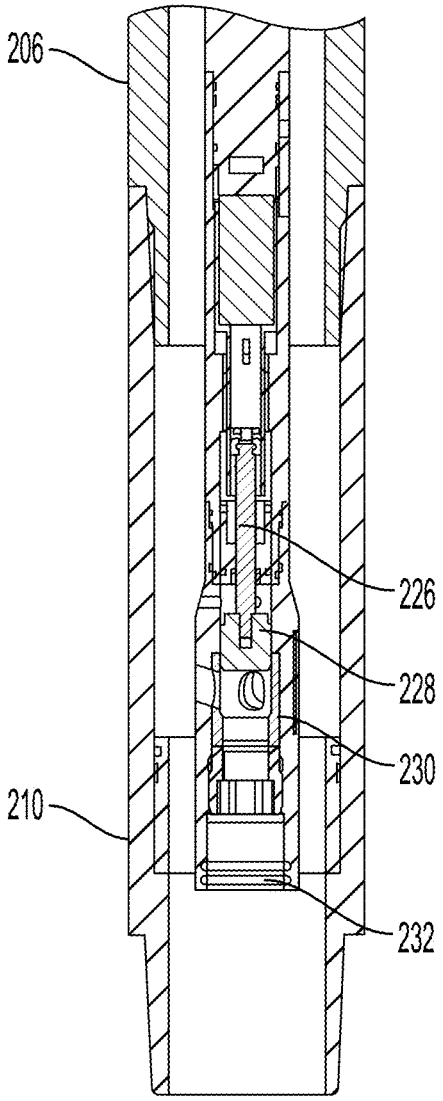
FIG. 8 is a cross-section of the activation device of FIG. 6 in a non-activated position.
Figure 9:
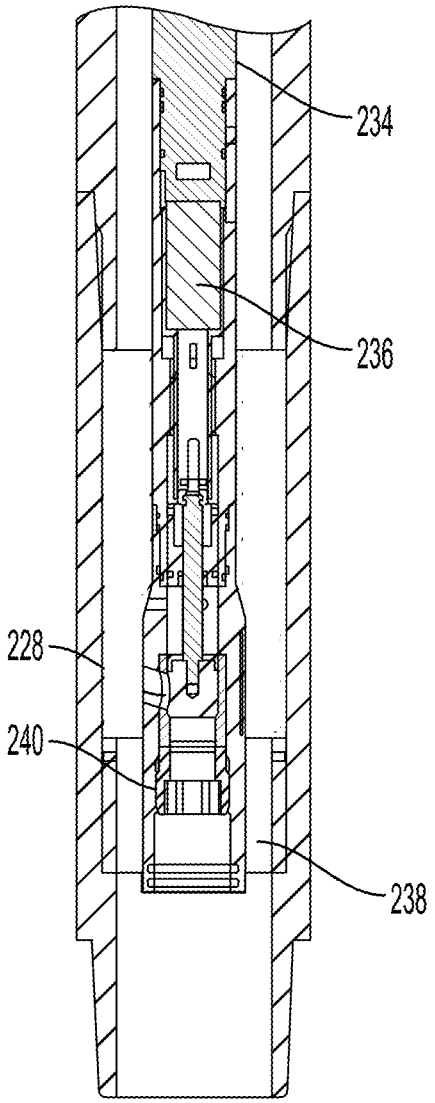
FIG. 9 is a cross-section of the activation device of FIG. 6 in an activated position.

Further details of the activation system are shown in FIGS. 8 and 9.

The bypass assembly has two nominal positions, open as shown in FIG. 8, and closed as shown in FIG. 9. The sonde contains the motor and motor bulkhead 234, which is connected to the ball screw 236. These components are not shown in detail but are commonly used in MWD pulser assemblies.

Below is the poppet rod 226, that is attached to the poppet head 228. The poppet rod 226 is driven by the motor 234 and ball screw 236, and changes position within the bypass sleeve 230. The bypass sleeve is held in place by the thread lock 240 to prevent it from moving axially or rotating relative to the bypass centralizer 238. When the bypass assembly has not been activated, flow is able to go through the outer flow path, through the outside of the bypass centralizer 238 or through the inner flow path of the bypass sleeve 230.

When the bypass assembly is activated, the poppet head 228 moves axially into the bypass sleeve 230, and thereby diverts 100% of the flow through the outer flow path around the bypass centralizer 230.

The power section assembly is connected to the lower end of the bypass centralizer 232 in such a way that it can be easily inserted after the electronics have been assembled. This allows for separate assembly of the electronics package from the rest of the tool.

Figure 10:
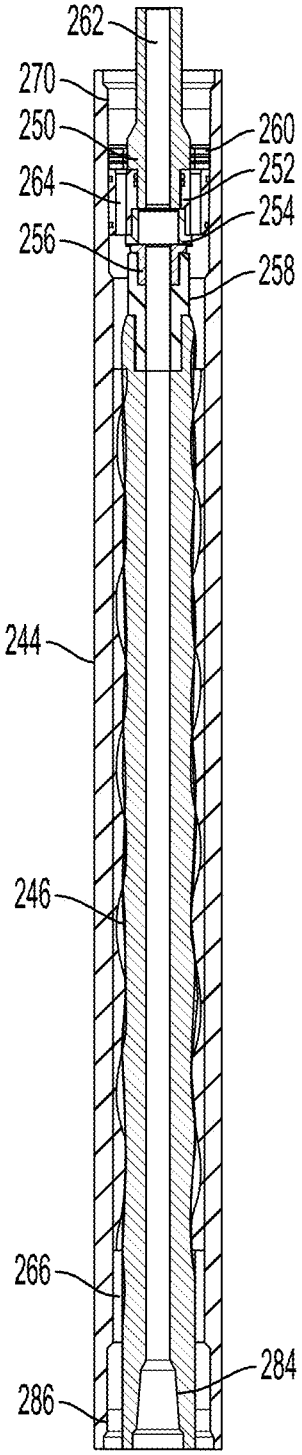
FIG. 10 is a cross-section of a power section assembly of the activation device of FIG. 6.

As shown in FIG. 10, the power section assembly 242 is primarily composed of an outer housing 244 called a stator, which is a steel tube with rubber bonded to the internal diameter. The rubber is profiled according to the principles of a Moineau pump, and has a corresponding rotor 246. A flow passage 266 is defined by the space between said rotor and stator. The rotor 246 also has a through bore 262 that allows fluid to flow through the assembly without entering the power section flow passage 266.

Additionally, the assembly has an upper thread 270 which connects to the housing of the electronics section, and a connecting tube 250 which can be inserted into the bypass centralizer 238 of the electronics assembly. This configuration allows for easy assembly of the electronics assembly 200 to the power section assembly 242.

The connecting tube 250 is inserted into the flow centralizer 252, which has an outer flow area 264 that leads to the power section flow passage 266. Pressed into the flow centralizer is a stationary orifice 254 that can be made of a hard material such as carbide and forms the stationary to rotary interface with the rotor 246. The rotor has a rotating orifice 256 pressed into an orifice adaptor 258 that is then threadedly connected to the rotor 246. The stationary orifice 254 is sized larger than the rotating orifice 256 so that even during the eccentric motion of the rotor 246 the flow path 262 is not restricted.

Additionally, a wave spring 260 which in alternate embodiments could also be a Belleville spring, preloads the stationary and rotating orifices against each other when the electronics housing 210 is threaded into the upper end of the stator 244. At the bottom of the power section assembly, connection 286 is a stator connection and connection 284 is a rotor connection.

Figure 11:
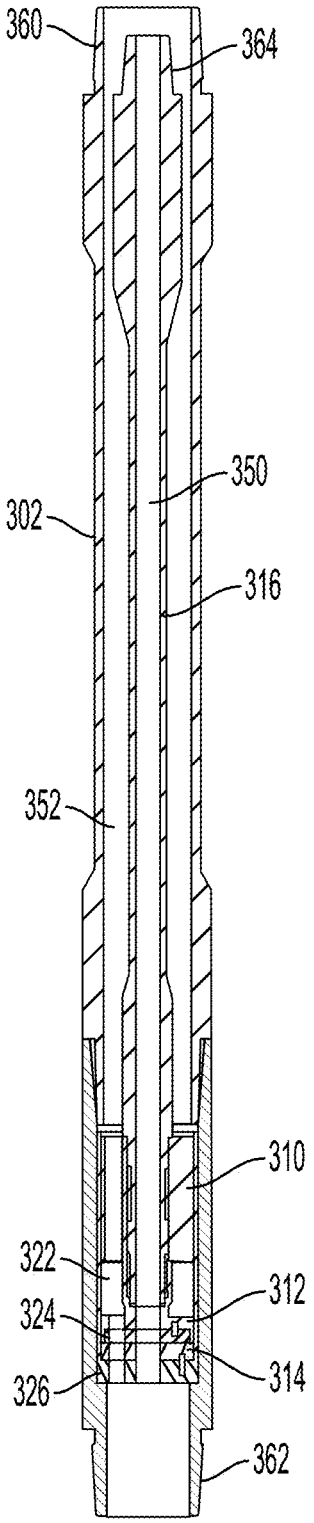
FIG. 11 is a cross-section of the valve assembly of the activation device of FIG. 6.

The valve section is shown in FIG. 11. In this embodiment, a flexshaft 316 is used to connect the rotor 246 to the valve assembly 318. This flexshaft contains a through bore 350 which once assembled is a continuation of the rotor through bore 262 shown in FIG. 10. Additionally, an outer flow path 352 exists around the outside of the flexshaft 316 and is a continuation of the power section flow path 266 from FIG. 10. The valve section has various connections 360, 362, 364.

The flexshaft 316 is then connected to a centralizer 310 to remove the eccentric motion of the rotor 246 before it reaches the valve assembly. The flexshaft 316 is also connected to the rotary valve holder 312 and rotary valve plate 324 which are defined by having a separate opening for each of the flow paths.

The housing 302 then contains an outer flow restrictor 322 which forms a mud lubricated journal bearing surface with the centralizer 310. Additionally, the stationary valve holder 326 and stationary valve plate 314 are pressed into the housing behind the outer flow restrictor 322. The rotary valve may have a portion that is always open through a full rotation relative to the stationary component. The stationary valve plate 314 and the rotary valve plate 324 have a through bore that is a continuation of the flexshaft through bore 350 that is always aligned regardless of the relative angle of the two plates. Various designs of rotary and stationary valve plates can be used. The specific layout of ports and/or the valve can vary depending on the tool design and the particular application.

The stationary 314 valve plate and rotary valve plate 324 also have one or multiple openings in line with the outer flow path 352 that will come into and out of alignment depending on the relative angle of the plates. It is generally advantageous to always have some percentage of the path open to prevent total cut-off of the flow through the outer flow path 352. As these plates rotate a variable pressure signal will be created that in combination with a responsive device (such as a shock tool) will impart an axial vibration to the drill string.

In this manner, the rotor 246 operates as a rotary driving device that converts fluid pressure to rotary motion. The rotary valve 324 has one or more openings connected to the rotary driving device and a stationary component 314 with one or more openings, and the rotation of the rotary valve varies alignment of the one or more openings of the rotary component relative to the one or more openings of the stationary component thereby varying flow through the rotary valve. There is a bypass passage 350 defining a flow path through the rotary valve and the rotor itself. The flow through the bypass passage is independent of the rotation of the rotor. An electrically activated assembly may be used to operate a bypass valve to vary an amount of flow through the bypass passage. The bypass valve may have various configurations and may be actuated electronically.

The processor may move the bypass valve in response to a measured parameter detected by the sensor reaching a pre-set value. The rotary driving device can be a device other than a rotor operating based on the principles of a Moineau pump. In other embodiments, the rotary driving device may be a turbine.

Figure 12:
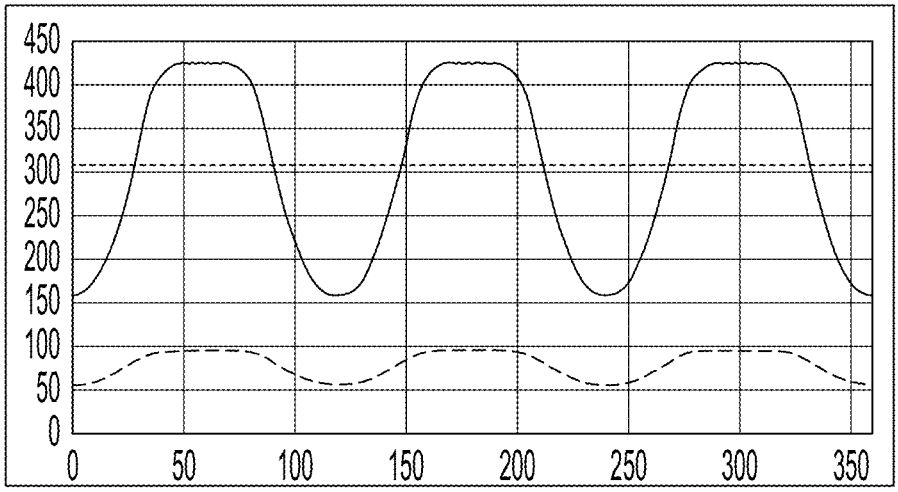
FIG. 12 is a chart showing the pressure signals when the valve is activated and not activated.

FIG. 12 shows the relative pressure drop of the tool shown in the embodiments in FIGS. 6-11 in the activated (upper line) and non-activated (lower line) states versus the relative angle of the rotary and stationary valve plates.

In the non-activated state, as the valve rotates it still produces a slight pressure pulse, but it is very minor compared with the activated pressure pulse (~6.5× less). As the area of the through bore is increased relative to the valve opening, the "off" pressure pulse will be reduced.

Throughout this patent document, the term "activated" refers to a friction-reducing vibration tool in a mode where a significant amount of vibrations are generated. The term "deactivated" refers to a friction-reducing vibration tool in a mode where the vibrations generated by the tool are minimal or non-existent. It will be understood by the person skilled in the art that even when a vibration tool is 'deactivated' that some amount of vibrations will still be generated, particularly because it is generally desirable that there is always some amount of flow through the rotary and stationary components of a valve in a vibration tool so that the valve does not get stuck in a non-flow position. In many cases, the vibration tool will be used in combination with a shock tool and the vibrations generated by the vibration tool will generate less force than is necessary to load the shock tool. That is, many shock tools have a set preload, so that the shock tool will not travel unless the force applied on it exceeds the preload value. If the shock tool preload can be set to a greater value than the non-activated pressure pulse will produce on the tool, then no vibration will be created in the "off" or "deactivated" position.

Figure 13:
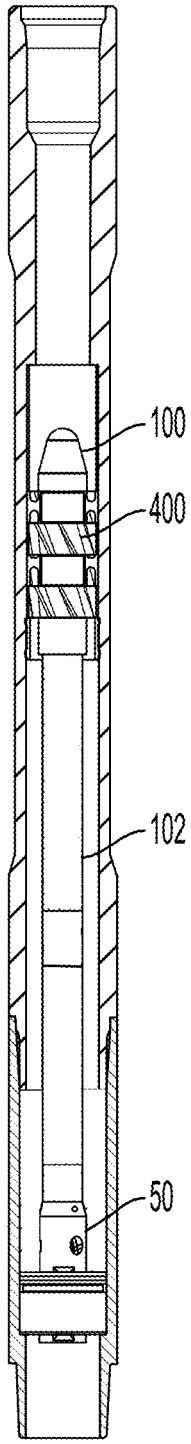
FIG. 13 is a partial cross-section of an electronics section of an embodiment of the activation device having a turbine.
Figure 14:
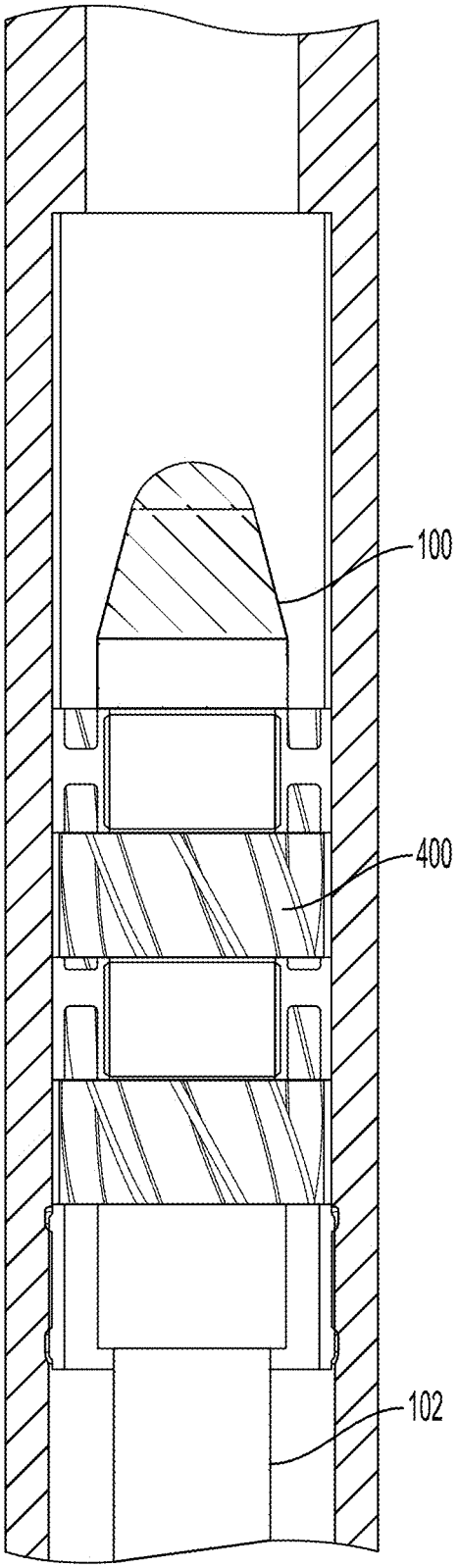
FIG. 14 is a close-up drawing view of FIG. 13.

FIGS. 13 and 14 shows an embodiment of an electronics assembly which uses a turbine 400 to create power for the electronics assembly. The remaining components of the system may be the same as shown in other embodiments.

In yet another embodiment there is a downhole valve and activation and deactivation system including a housing that separates the standpipe flow from the annulus flow. A valve body separates the standpipe flow into two or more flow paths. A valve poppet is received by the valve body in order to alter or modify at least one of the flow paths. There is a linear activation system composed of an electric motor and a ball screw. A sensor measures external stimuli and activates/deactivates the system. A battery powers the sensor and linear activation system. The valve body may be made of a hardened material to prevent or limit wash. The valve poppet may be made of a hardened material to prevent or limit wash. The linear activation system may have a gear box between the electric motor and ball screw to increase the available closing force. The sensor may be one or more of: an accelerometer set up to measure inclination, a magnetometer set up to measure inclination, a pressure sensor that measures annulus pressure, a pressure sensor that measures standpipe pressure, and a thermocouple and measures temperature.

In another there is a downhole valve and embodiment activation/deactivation system for modifying the fluid flow around a power section having a housing that separates the standpipe flow from the annulus flow. A valve body separates the standpipe flow into two paths. The first path is between the rotor and stator of the power section. The second path is through the bore in the rotor. A valve poppet is receivable by the valve body in order to block the second fluid path. A linear activation system includes an electric motor and a ball screw. A sensor measures external stimuli and activates/deactivates the system. A battery powers the sensor and linear activation system. The valve body is made of a hardened material to prevent or limit wash. The valve poppet may be made of a hardened material to prevent or limit wash. The linear activation system may have a gear box between the electric motor and ball screw to increase the available closing force. The sensor may be one or more of: an accelerometer that is set up to measure inclination, a magnetometer that is set up to measure inclination, a pressure sensor that measures annulus pressure, a pressure sensor that measures standpipe pressure, and a thermocouple and measures temperature. The normal position of the valve poppet may be "closed" and the system "opens" the secondary flow path when activated.

In yet another embodiment there is disclosed an activation system for a downhole valve. A rotary driving device converts fluid pressure to rotary motion. There is a valve composed of a rotary component with one or multiple openings and a stationary component with one or multiple openings that will align with the rotary openings for at least a partial rotation of the rotary component relative to the stationary component, thereby varying the total flow area throughout the rotation. A bypass passage extends around or through said valve and said rotary driving device. There is a means for substantially plugging said bypass passage. An electrically activated assembly is capable of both plugging and unplugging said bypass. A sensor initiates the activation in response to a measured parameter reaching a pre-set value. The rotary driving device may operate based on the principles of a Moineau pump. The rotary driving device may be a turbine. The valve may have a portion that is always open, regardless of the relative positions of the stationary and rotary components. The electrically activated assembly may be in the form of an electric motor coupled to a ball screw to create linear motion. The means to plug the bypass passage may be in the form of a poppet valve. The means to plug the bypass passage may be rotating a plate relative to a second plate to modify the available flow passages. The sensor may be one or more of: an inclination sensor in the form of an accelerometer, an inclination sensor in the form of a magnetometer, a flow sensor measuring the flow rate, a pressure sensor that is measuring the annulus pressure, and a pressure sensor that is measuring the standpipe pressure.

In yet another embodiment there is an activation system for a downhole valve including a rotary driving device, a rotary valve, a bypass passage around or through said valve, a means for substantially plugging said bypass passage, and an electrically activated assembly capable of plugging said bypass. A sensor initiates the activation in response to a measured parameter reaching a pre-set value. The rotary driving device may be a Moineau pump. The rotary driving device may be a turbine. The valve may have a portion that is always open, regardless of the relative positions of the stationary and rotary components. The sensor may be one or more of: an inclination sensor in the form of an accelerometer, an inclination sensor in the form of a magnetometer, a flow sensor measuring the flow rate, a pressure sensor that is measuring the annulus pressure, and a pressure sensor that is measuring the standpipe pressure.

In yet another embodiment there is disclosed the use of an electro-magnetic (EM) signal to initiate the activation. There is an activation system for a downhole valve. The activation system includes a rotary driving device, a rotary valve, a bypass passage around or through said valve, a means for substantially blocking said bypass passage, an electrically driven activation device for said means of substantially blocking said passage, and a means to receive an activation command through an electro-magnetic signal. This embodiment may use RFID tags.

Figure 15:
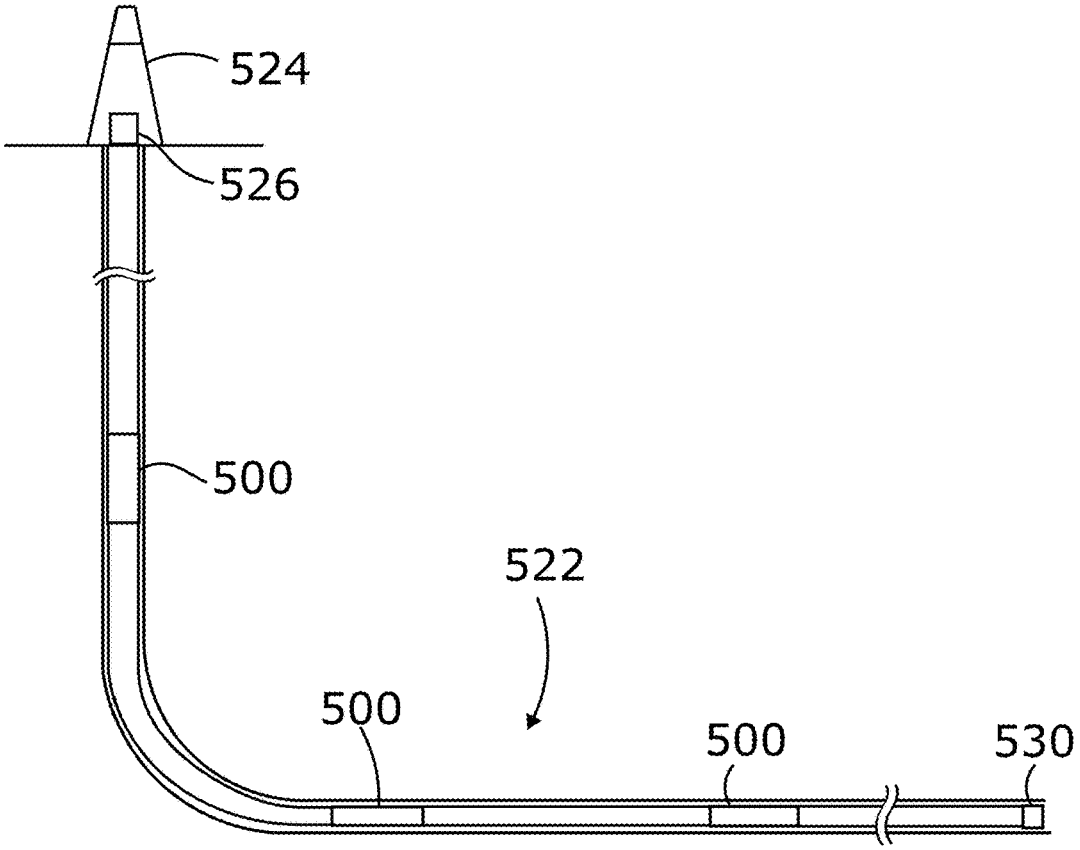
FIG. 15 is a schematic of a lateral well profile with multiple friction-reducing vibration tools in the drill string.

FIG. 15 shows a schematic of a well profile with multiple downhole tools 500 each including a friction-reducing vibration tool in a drill string 522. At surface is a drilling rig 524 which includes various surface equipment. At the downhole end of the drill string 522 is the drill bit 530. Various other pieces of downhole equipment may be present within the drill string, including measurement while drilling (MWD) tools, the drilling motor and other equipment. The surface equipment includes a control signal generator 526, which may be a standard surface pump or other device which can generate one or more signals which can be detected downhole. Multiple on-demand downhole tools 500 each including a friction-reducing vibration tool may be used in the drill string during drilling. Each of the friction-reducing vibration tools can be activated and deactivated on demand. For example, in the example shown, only the two friction-reducing vibration tools that are in the horizontal section of the well bore may be in the active position. The friction-reducing vibration tool in the vertical section of the wellbore may be deactivated. In other embodiments, all of the friction-reducing vibration tools can be activated or deactivated collectively.

In most cases, it is the operator of the drilling rig who would determine when it wants to send the signals to activate or deactivate the vibration tool based on the drilling program. This would generally be done by varying the pumps on the rig or rotating the top drive. One benefit of a 'group off' command sent to all vibration tools simultaneously is that in deep lateral wells the multiple vibration tools create pressure pulse noise. Shutting all of the vibration tools off at once can be beneficial for reading MWD signals at depth to reduce noise. All of the vibration tools could then be activated after the MWD signals are processed and the operator will continue drilling.

Figure 16:
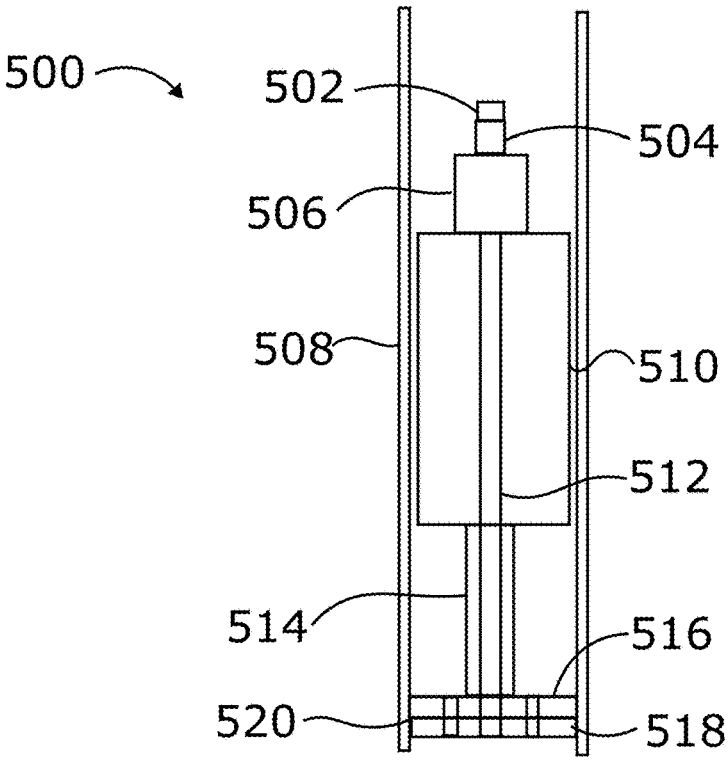
FIG. 16 is a schematic of a downhole tool including friction-reducing vibration tool and a bypass control.
Figure 17A:
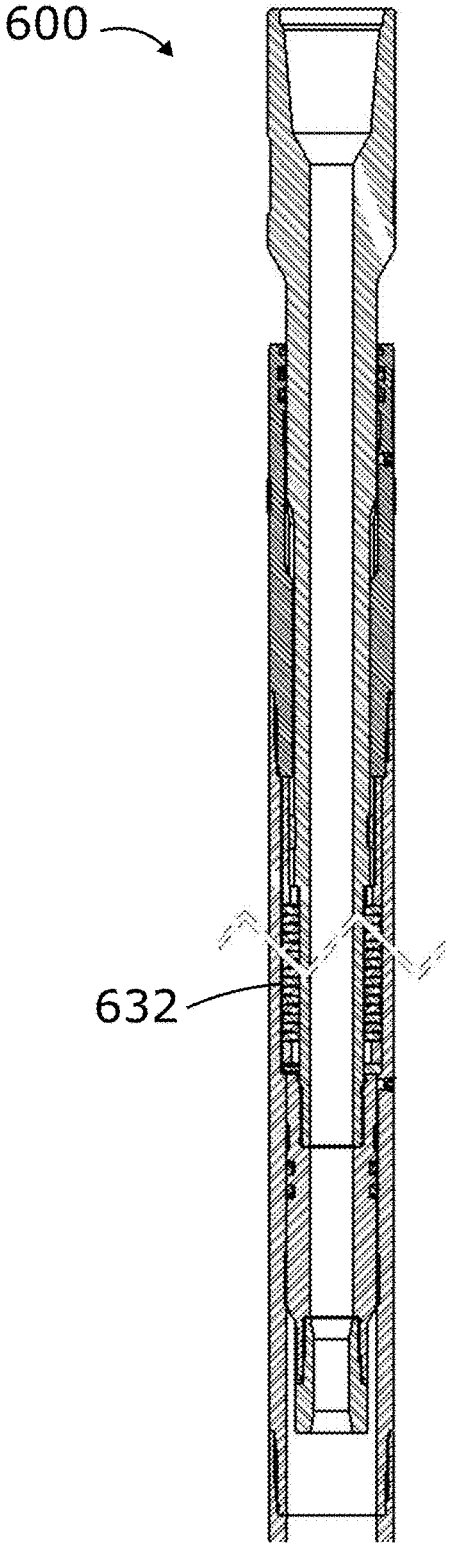
FIGS. 17A to 17D show section views of a cross-section of a downhole tool including a friction-reducing vibration tool with a bypass control below the vibration tool. The downhole tool in FIGS. 17A to 17D are shown with the most uphole portion of the tool in FIG. 17A and the most downhole portion of the tool in FIG. 17D, with the figures placed in order from most uphole to most downhole from 17A to 17D.
Figure 17B:
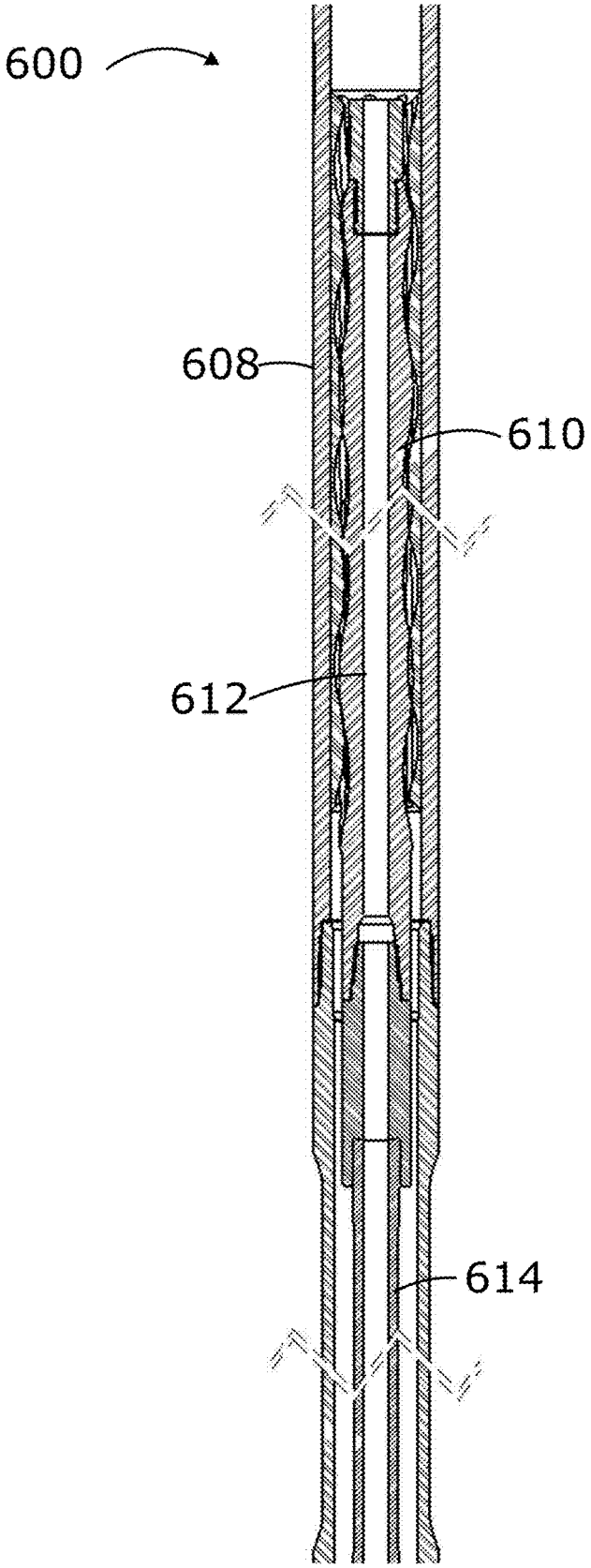
Figure 17C:
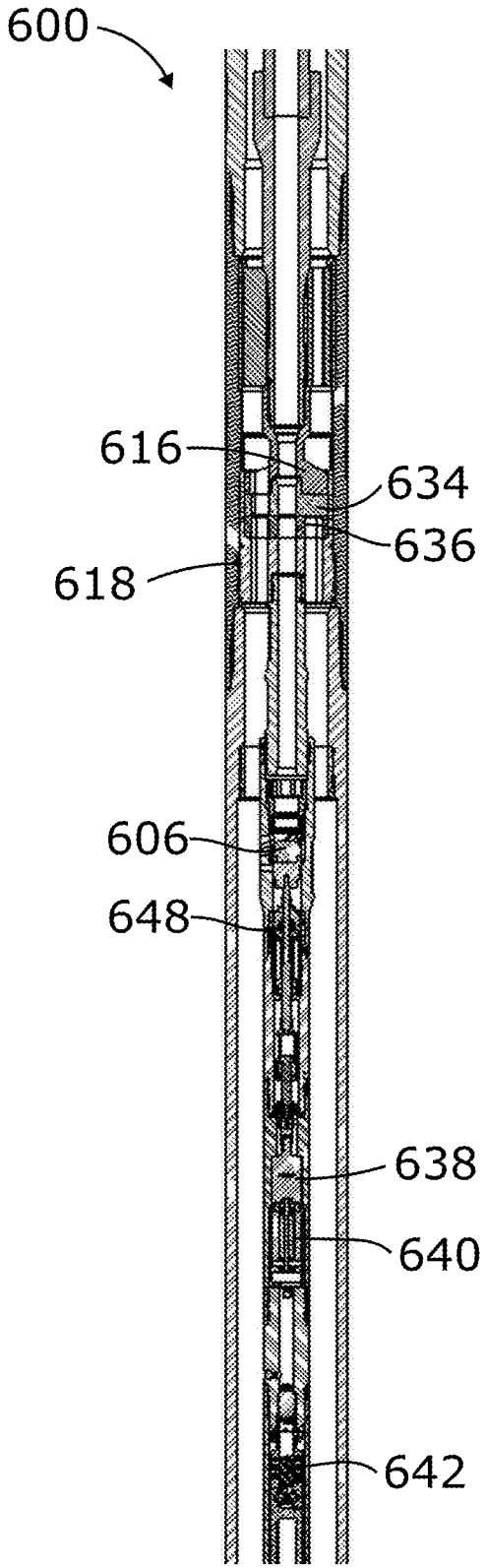
Figure 17D:
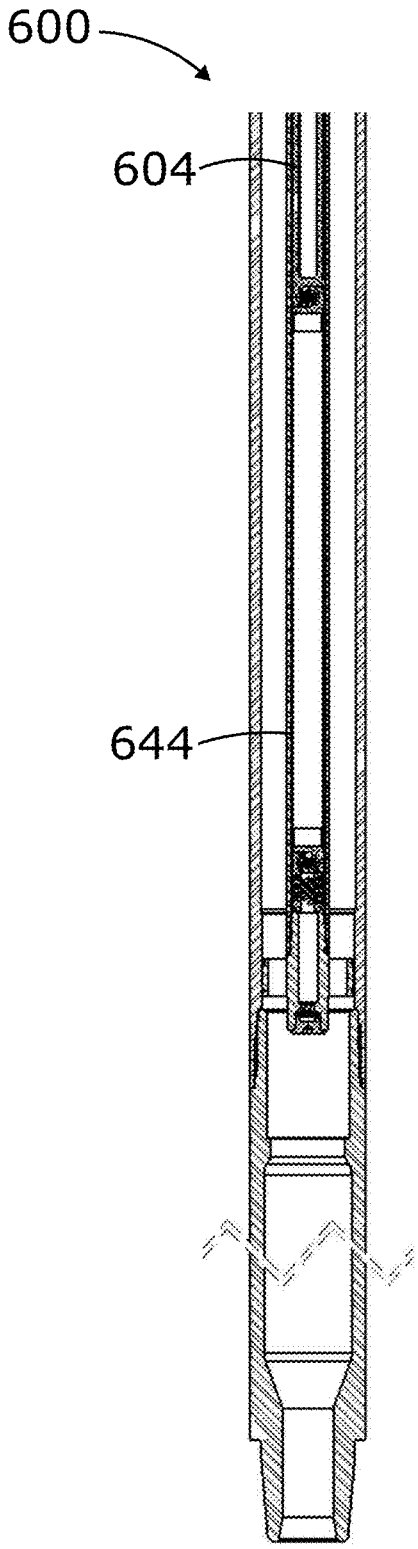

FIG. 16 is a schematic of a downhole tool 500 for use in a drill string including a friction-reducing vibration tool and a bypass control. As shown in FIG. 15, one or more of the downhole tools 500 may be installed in a drill string during drilling. The downhole tool 500 includes a friction-reducing vibration tool, which includes a rotary driving device 508, 510 which is responsive to fluid flow in the drill string. For example, the rotary driving device may be a Moineau-style rotor 510 within a stator 508 as shown in FIG. 10. Alternatively, the rotary driving device may be a turbine as shown in FIG. 14. The friction-reducing vibrating tool includes a valve 520 having a rotary component 516 and a stationary component 518 configured to rotate relative to each other to vary flow through the valve. The rotary component 516 and stationary component 518 may have various configurations and orientations, including rotating relative to each other in which one component sits within the other component and one rotates around the other, or in which the two components face each other and the rotary components rotates around the central axis of the drilling string and the stationary component is fixed relative to the axis of the drill string. The faces of the valves may have various configurations. The rotary and stationary components may have various different designs of one or more openings that may pass in and out of alignment as the components rotate relative to each other. In general, there will always be some flow through the valve components regardless of the relative rotational positions of the components. The rotary component of the valve is driven by the rotary driving device 510.

As shown in FIG. 16, a bypass passage 512 extends around or through one or more of the rotary driving device 508 and the valve 520. In the embodiment shown in FIG. 16, the bypass passage 512 extends through the rotor 510 of the Moineau-style rotor, through a flex shaft 514 and into the valve 520. In other embodiments, the bypass passage may extend only through the rotary driving device 508, or only through the valve 520. In the case that the bypass passage extends only though the rotary driving device 508, then the speed of rotation of the valve can be controlled by the amount of fluid that passes through the bypass passage in contrast to the amount of fluid that passes through the rotor. In the case that the bypass passage extends only through the valve 520, then the amount of vibrations generated by the friction-reducing vibration device will be controlled by the amount of fluid that bypasses the valve and does not pass through the openings that vary as the rotary and stationary components rotate relative to each other.

There is a bypass control that includes a sensor 502 for detecting a stimulus, a bypass actuator 506 for controlling an amount of fluid flow through the bypass passage to activate or deactivate the friction-reducing vibration tool, and a processor 504 in communication with the sensor 502 to control the bypass actuator 506 in response to signals from the sensor indicative of the stimulus being detected. The bypass control may include a battery connected to the sensor and the processor.

As described elsewhere in this patent application, the stimulus may be a condition downhole. For example, the detected stimulus may be a condition indicative that the drill string is in a horizontal section of a well. In that case, the bypass control may be programmed to activate the friction-reducing vibration tool in response to the sensor detecting that the drill string is in the horizontal section of the well. Similarly, the detected stimulus may be a condition indicative that the drilling string is in a vertical section of the well. In that case, the bypass control may be programmed to deactivate the friction-reducing vibration tool in response to the sensor detecting that the drill string is in the vertical section of the well.

The sensor can detect conditions downhole by detecting inclination angles of the tool or by detecting depth based on hydrostatic pressure.

In other embodiments, the stimulus is a control signal received from surface. For example, the control signal may be a series of timed pump cycles, a series of timed rotary cycles, or a variation in pressure cycles. More generally, the control signal may be any electronic or fluid property which can be transmitted downhole from the surface. Any type of variation in fluid pressure or rate that is detectable downhole can be used to generate a signal for the bypass control. The functionality created by the control signal generator may be merely programing added to a pre-existing device at surface. For example, a standard mud pump may be programmed to generate control signals which can be detected by the bypass control. The decision when to activate the one or more friction-reducing vibration tools may be determined based on pre-calculated properties of the expected drilling operation or based on conditions that are detected downhole by one or more sensors, including the MWD. The decision when to activate the vibration tools may depend on various factors, including the number of vibration tools in the drill string and the distances between them. Different operators may have different preferences for the timing of activating each of the vibration tools. In some cases, it may only be necessary to activate the vibration tools when the drill string extends through a pre-determined length of a horizontal section of the wellbore.

Various designs as disclosed herein may be used as the bypass actuator. For example, the bypass actuator may be an electric motor and a ball screw as shown in the embodiment in FIGS. 7-9. The bypass actuator may be a valve poppet as shown in the embodiment shown in FIGS. 1-3 that is axially moveable to vary the amount of fluid flow through the bypass passage. In some embodiments, the bypass can be closed by a rotary valve actuator. For instance, instead of the electronics turning a ball screw to axially move a poppet, the electric motor could turn a plate valve from open to close or vice versa.

The sensor may be one or more of: an accelerometer, a magnetometer, a pressure sensor or a thermocouple.

Embodiments of the friction-reducing vibration tools described herein may be activated or deactivated downhole. A stimulus is detected using a sensor. The friction-reducing vibration tool is electrically activated or deactivated in response to signals from the sensor indicative of the stimulus being detected. In some embodiments, as described above, a control signal is generated from surface to active or deactivate the friction-reducing vibration tool. The control signal may be transmitted downhole, for example, through operation of the control signal generator, wherein the control signal is the stimulus. A plurality of friction-reducing vibration tools may be activated or deactivated in a drill string at the same time using the same control signal.

As shown in FIG. 16, the friction-reducing vibration tool may include a rotary driving device responsive to fluid flow in the drill string, a valve includes a rotary component and a stationary component configured to rotate relative to each other to vary flow through the valve, the rotary component of the valve driven by the rotary driving device, and a bypass passage around or through one or more of the rotary driving device and the valve, and wherein electrically activating or deactivating the friction-reducing vibration tool comprises activating or deactivating a bypass control to vary the flow through the bypass passage.

A bypass actuator controls an amount of fluid flow through the bypass passage to activate or deactivate the friction-reducing vibration tool, and a processor in communication with the sensor to control the bypass actuator in response to signals from the sensor indicative of the stimulus being detected.

Figure 18A:
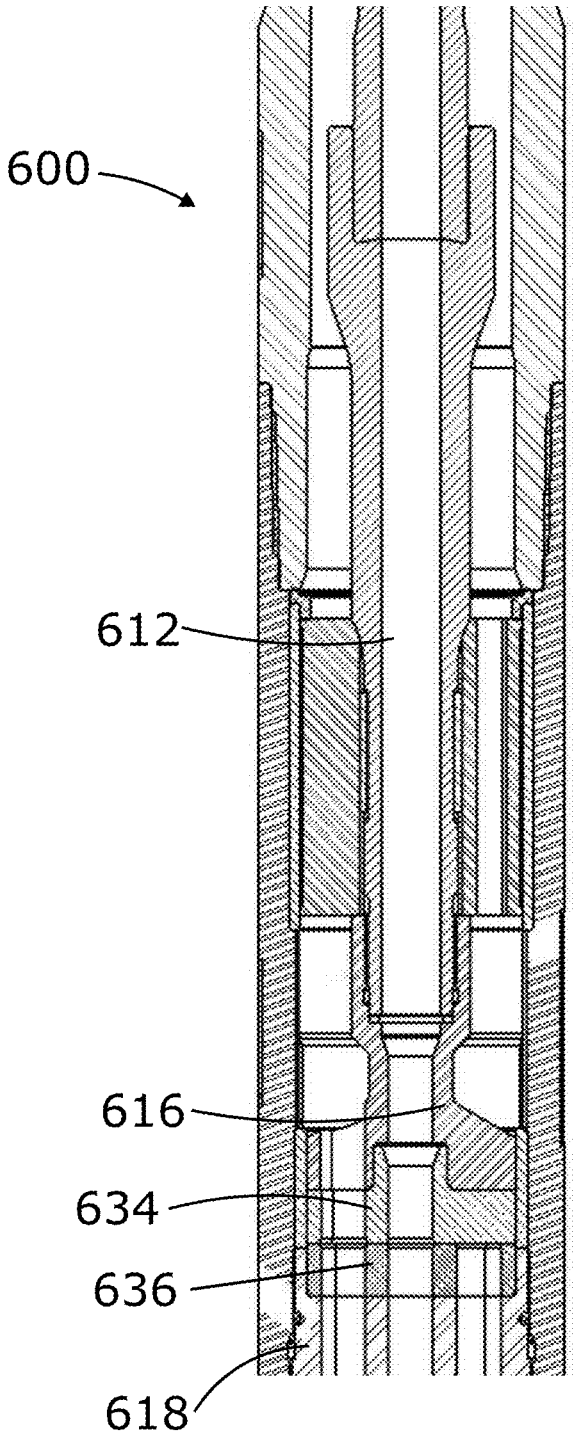
FIGS. 18A to 18C show section views of a cross-section of a close-up of the downhole tool of FIGS. 17A to 17D. The downhole tool in FIGS. 18A to 18C are shown with the most uphole portion of the tool in FIG. 18A and the most downhole portion of the tool in FIG. 18C, with the FIG. 18B being the portion of the tool between FIGS. 18A and 18C.
Figure 18B:
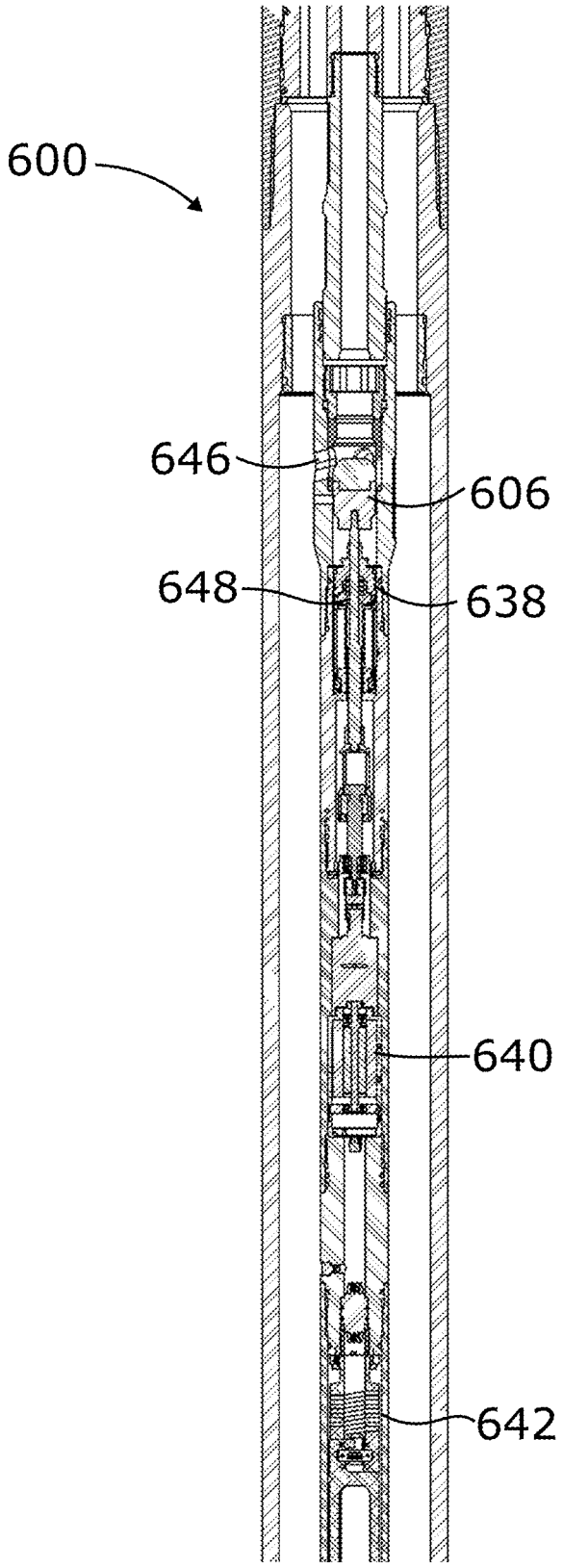
Figure 18C:
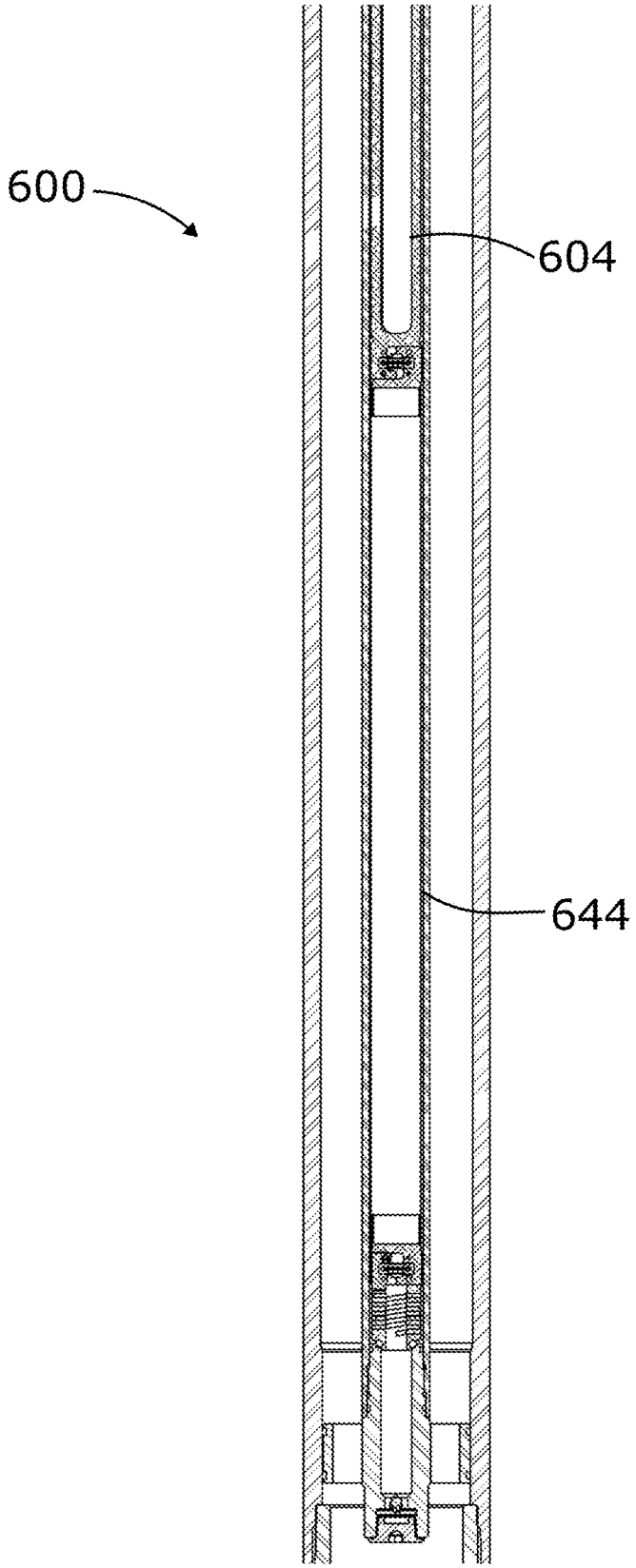

FIGS. 17 and 18 show a downhole tool 600 including a friction-reducing vibration tool in which the actuator assembly is below the rotary valve to remove any need for the stationary orifice 254 (FIG. 10) that forms the stationary to rotary interface with the rotor 246 (FIG. 10). On the uphole end of the tool 600 is a shock tool 632 (FIG. 17A). Below the shock tool is the power section of the vibration tool (FIG. 17B), which includes a stator 608 and a rotor 610. A bypass passage 612 extends through the rotor 610. A flex shaft 614 connects between the rotor 610 and the rotary component 616 of the valve. Each of the flex shaft 614 and the valve include the bypass passage 612. The valve includes the rotary component 616 (FIG. 17C) and the stationary component 618. The portions of the rotary component 616 and the stationary component 618 which are in face-to-face contact may be carbide inserts, including a rotary carbide face 634 and a stationary carbide face 636. The stationary component 618 of the valve is connected to a poppet 606 which operates to open and close a bypass opening 646 (FIG. 18B). The opening and closing of the bypass opening 646 will vary the amount of fluid flow through the bypass passage 612. The poppet 606 is actuated by an electric motor 640 (FIG. 18B) which drives a gear box 638 which in turn moves the poppet 606 via a ball screw 648. Collectively, the electric motor 640, the gear box 638, the ball screw 648 and the poppet 606 form a bypass actuator. The control for the bypass actuator is provided by a circuit board 604 (FIG. 18C) which contains both a processor and a sensor. Between the electric motor 640 and the circuit board 604 there is a snubber 642 (FIG. 18B) for absorbing axial vibration. Downhole of the circuit board 604 is a battery 644 (FIG. 18C). Collectively, the battery 644, the circuit board 604, the snubber 642, the electric motor 640, the gear box 638, the ball screw 648 and the poppet 606 form a bypass control.

FIG. 18 shows a close-up view of the downhole tool of FIG. 17. This shows the bypass opening 646 (FIG. 18B) more clearly. The fluid flow through the drill string will go through the valve and rotor in the off position. At the poppet 606 there are three bypass openings 646 or ports to return the flow together into the annulus where it will flow around the electronics. Any number or shape of ports may be used so long as sufficient flow may be directed through the bypass passage to functionally deactivate the vibration tool. When the poppet 606 closes the bypass openings 646, all flow goes through the valve and then around the electronics. When the poppet 606 opens the bypass openings, then some amount of fluid flow will be directed through the center of the rotor and through the center of the valve, which functionally shifts the vibration tool into the deactivated position whereby the vibration of the tool is significantly diminished.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

What is claimed is:

1. A downhole tool for use in a drill string, comprising:

a friction-reducing vibration tool, comprising:

a rotary driving device responsive to fluid flow in the drill string, a valve including a rotary component and a stationary component configured to rotate relative to each other to vary flow through the valve, the rotary component of the valve driven by the rotary driving device, and a bypass passage around or through one or more of the rotary driving device and the valve; and a bypass control, comprising:

a sensor for detecting a stimulus, a bypass actuator for controlling an amount of fluid flow through the bypass passage to activate or deactivate the friction-reducing vibration tool, and a processor in communication with the sensor to control the bypass actuator in response to signals from the sensor indicative of the stimulus being detected.

2. The downhole tool of claim 1 wherein the stimulus is a condition downhole.

3. The downhole tool of claim 1 wherein the stimulus is a control signal received from surface.

4. The downhole tool of claim 3 wherein the control signal is a series of timed pump cycles.

5. The downhole tool of claim 3 wherein the control signal is a series of timed rotary cycles.

6. The downhole tool of claim 3 wherein the control signal is a variation in pressure cycles.

7. The downhole tool of claim 1 wherein the rotary driving device is a Moineau-style rotor within a stator.

8. The downhole tool of claim 1 wherein the bypass actuator further comprises an electric motor and a ball screw.

9. The downhole tool of claim 1 wherein the bypass actuator further comprises a valve poppet that is axially moveable to vary the amount of fluid flow through the bypass passage.

10. The downhole tool of claim 1 wherein the sensor is one or more of: an accelerometer, a magnetometer, a pressure sensor or a thermocouple.

11. A method of activating or deactivating a friction-reducing vibration tool in a drill string, wherein the friction-reducing vibration tool comprises a rotary driving device responsive to fluid flow in the drill string, a valve including a rotary component and a stationary component configured to rotate relative to each other to vary flow through the valve, the rotary component of the valve driven by the rotary driving device, and a bypass passage around or through one or more of the rotary driving device and the valve, the method comprising:

detecting a stimulus using a sensor; and electrically activating or deactivating a bypass control to vary the flow through the bypass passage in response to signals from the sensor indicative of the stimulus being detected.

12. The method of claim 11 further comprising:

generating a control signal from surface; and transmitting the control signal downhole, wherein the control signal is the stimulus.

13. The method of claim 12 further comprising activating or deactivating a plurality of friction-reducing vibration tools in a drill string at the same time using the control signal.

14. The method of claim 12 wherein the control signal is a series of timed pump cycles.

15. The method of claim 12 wherein the control signal is a series of timed rotary cycles.

16. The method of claim 12 wherein the control signal is a variation in pressure cycles.

17. The method of claim 11 wherein the stimulus is a condition downhole.

18. The method of claim 11, wherein the bypass control comprises:

the sensor, a bypass actuator for controlling an amount of fluid flow through the bypass passage to activate or deactivate the friction-reducing vibration tool, and a processor in communication with the sensor to control the bypass actuator in response to signals from the sensor indicative of the stimulus being detected.

* * * * *